US010077159B1

(12) United States Patent
Lin

(10) Patent No.: US 10,077,159 B1
(45) Date of Patent: Sep. 18, 2018

(54) PAPER TRANSPORTING STRUCTURE

(71) Applicant: HON HAI PRECISION INDUSTRY CO., LTD., New Taipei (TW)

(72) Inventor: Yu-Sheng Lin, New Taipei (TW)

(73) Assignee: HON HAI PRECISION INDUSTRY CO., LTD., New Taipei (TW)

( * ) Notice: Subject to any disclaimer, the term of this patent is extended or adjusted under 35 U.S.C. 154(b) by 0 days.

(21) Appl. No.: 15/790,077

(22) Filed: Oct. 23, 2017

(30) Foreign Application Priority Data

Aug. 18, 2017 (CN) ..... 2017 1 0711906

(51) Int. Cl.
*B65H 9/04* (2006.01)
*B65H 5/36* (2006.01)
*B65H 5/06* (2006.01)

(52) U.S. Cl.
CPC ..... *B65H 5/36* (2013.01); *B65H 5/062* (2013.01); *B65H 2301/449* (2013.01); *B65H 2301/44552* (2013.01); *B65H 2301/443246* (2013.01); *B65H 2801/06* (2013.01)

(58) Field of Classification Search
CPC ..... B65H 5/36; B65H 2301/449; B65H 2301/443246; B65H 2301/44552
See application file for complete search history.

(56) References Cited

U.S. PATENT DOCUMENTS 6,581,514 B2 * 6/2003 Kakurai ..... B65H 5/062 101/118
7,984,909 B2 * 7/2011 Sunohara ..... B65H 5/36 271/186
8,413,986 B2 * 4/2013 Nakaishi ..... B65H 29/125 271/188
2016/0279971 A1 * 9/2016 Iijima ..... B41J 11/007
2017/0029231 A1 * 2/2017 Iwami ..... G03G 15/6529

* cited by examiner

*Primary Examiner* — Howard J Sanders
(74) *Attorney, Agent, or Firm* — ScienBiziP, P.C.

(57) ABSTRACT

A paper transporting structure defines a paper transport channel and includes a sliding piece, a fixing holder, a rotating arm, and an elastic member. When the sliding piece slides to a first position of the fixing holder, the sliding piece is fixed at the first position and abuts the rotating arm to hold the rotating arm positioned at a first paper transporting angle. When the sliding piece slides to a second position of the fixing holder, the elastic member rebounds and drives the rotating arm to rotate to a second paper transporting angle.

20 Claims, 5 Drawing Sheets

PAPER TRANSPORTING STRUCTURE

FIELD

The subject matter herein generally relates to paper transporting structures.

BACKGROUND

Printers include a paper transporting structure and a printing body. The paper transporting structure defines a paper transport channel. Paper passes through the paper transport channel to enter into a paper inlet of the printing body. A position of an outlet of the paper transport channel is typically fixed. The paper inlet of various printing bodies can be different. Thus, one paper transporting structure only matches one type of printing body.

BRIEF DESCRIPTION OF THE DRAWINGS

Implementations of the present technology will now be described, by way of example only, with reference to the attached figures.

DETAILED DESCRIPTION

Figure 1:
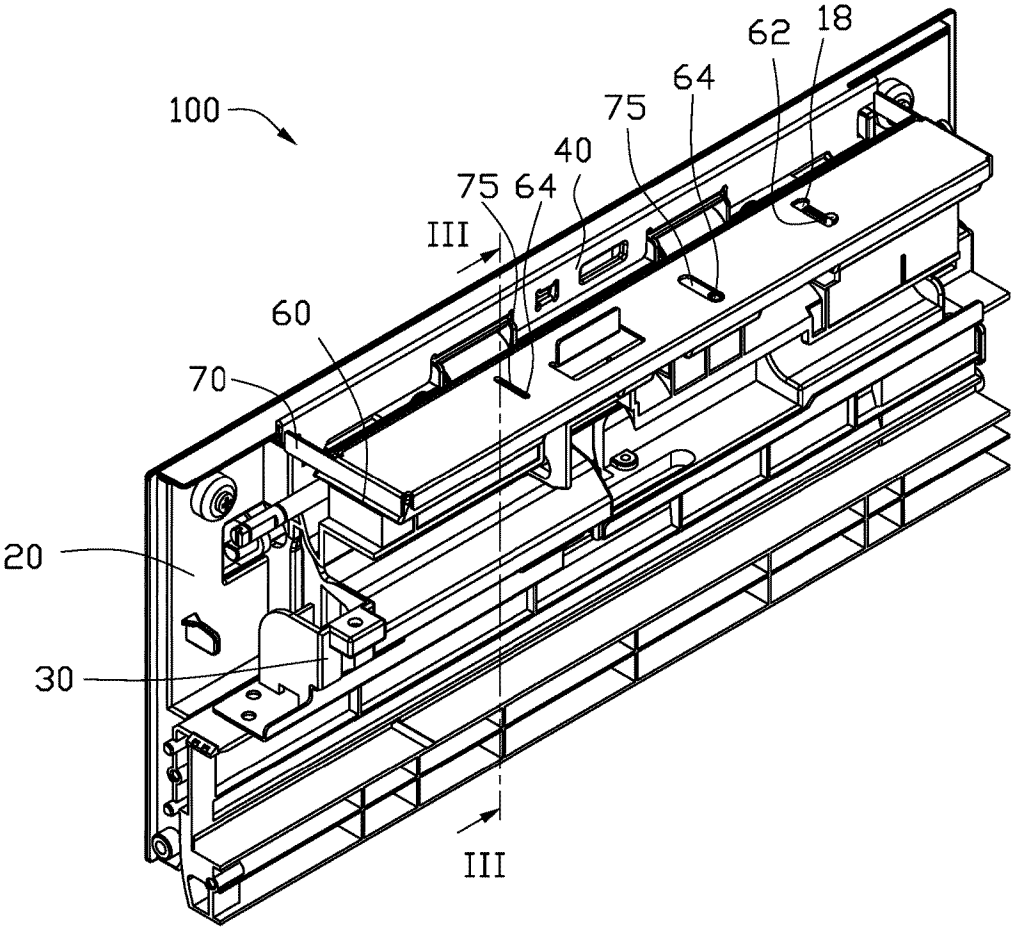
FIG. 1 is an isometric view of an exemplary embodiment of a paper transporting structure with a rotating arm positioned at a first paper transporting angle.

It will be appreciated that for simplicity and clarity of illustration, where appropriate, reference numerals have been repeated among the different figures to indicate corresponding or analogous elements. In addition, numerous specific details are set forth in order to provide a thorough understanding of the exemplary embodiments described herein. However, it will be understood by those of ordinary skill in the art that the exemplary embodiments described herein can be practiced without these specific details. In other instances, methods, procedures, and components have not been described in detail so as not to obscure the related relevant feature being described. The drawings are not necessarily to scale and the proportions of certain parts may be exaggerated to better illustrate details and features. The description is not to be considered as limiting the scope of the exemplary embodiments described herein. The disclosure is illustrated by way of example and not by way of limitation in the figures of the accompanying drawings, in which like references indicate similar elements. It should be noted that references to "an" or "one" exemplary embodiment in this disclosure are not necessarily to the same exemplary embodiment, and such references mean "at least one."

The term "comprising" means "including, but not necessarily limited to"; it specifically indicates open-ended inclusion or membership in a so-described combination, group, series, and the like.

Figure 2:
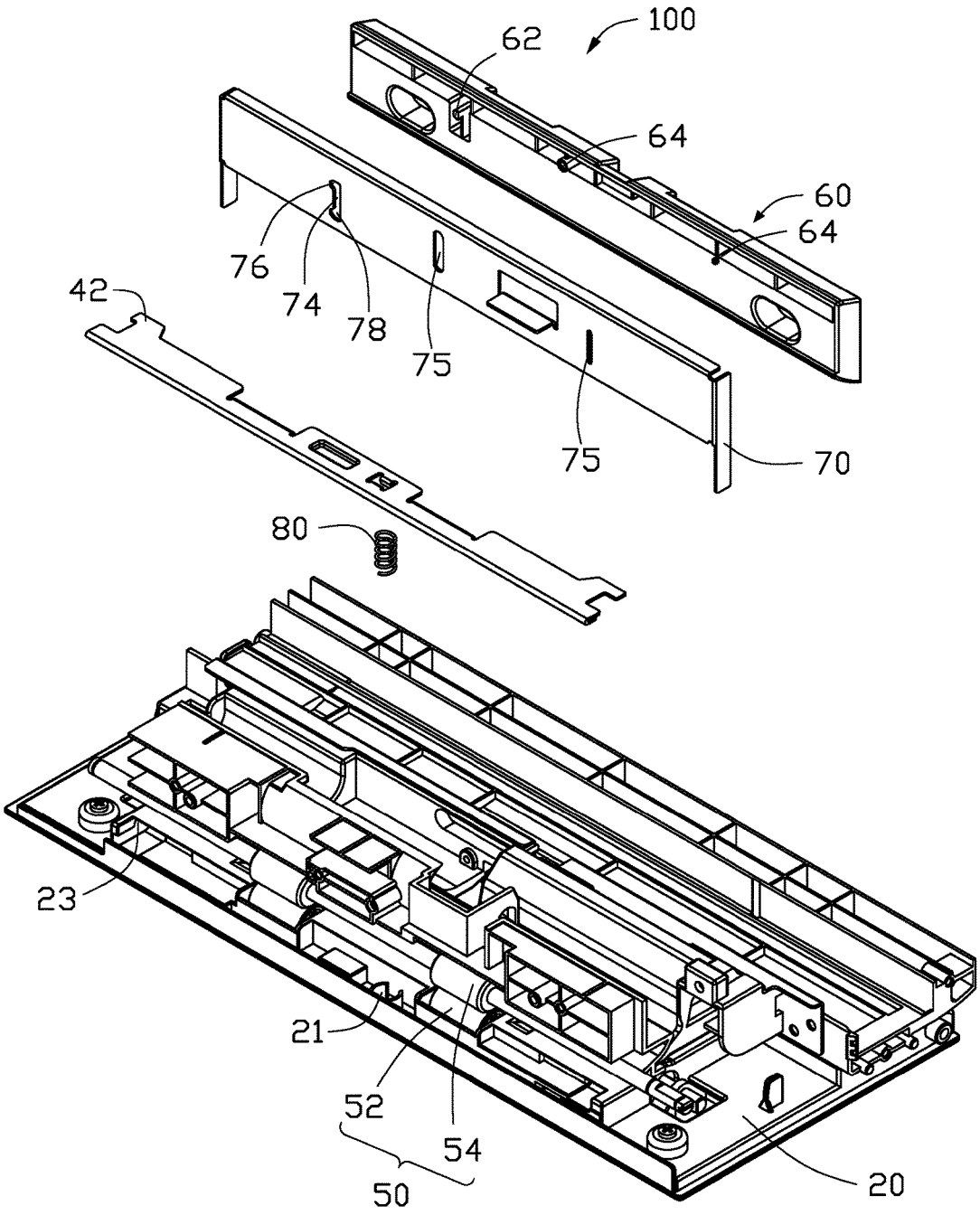
FIG. 2 is an exploded view of the paper transporting structure of FIG. 1.
Figure 3:
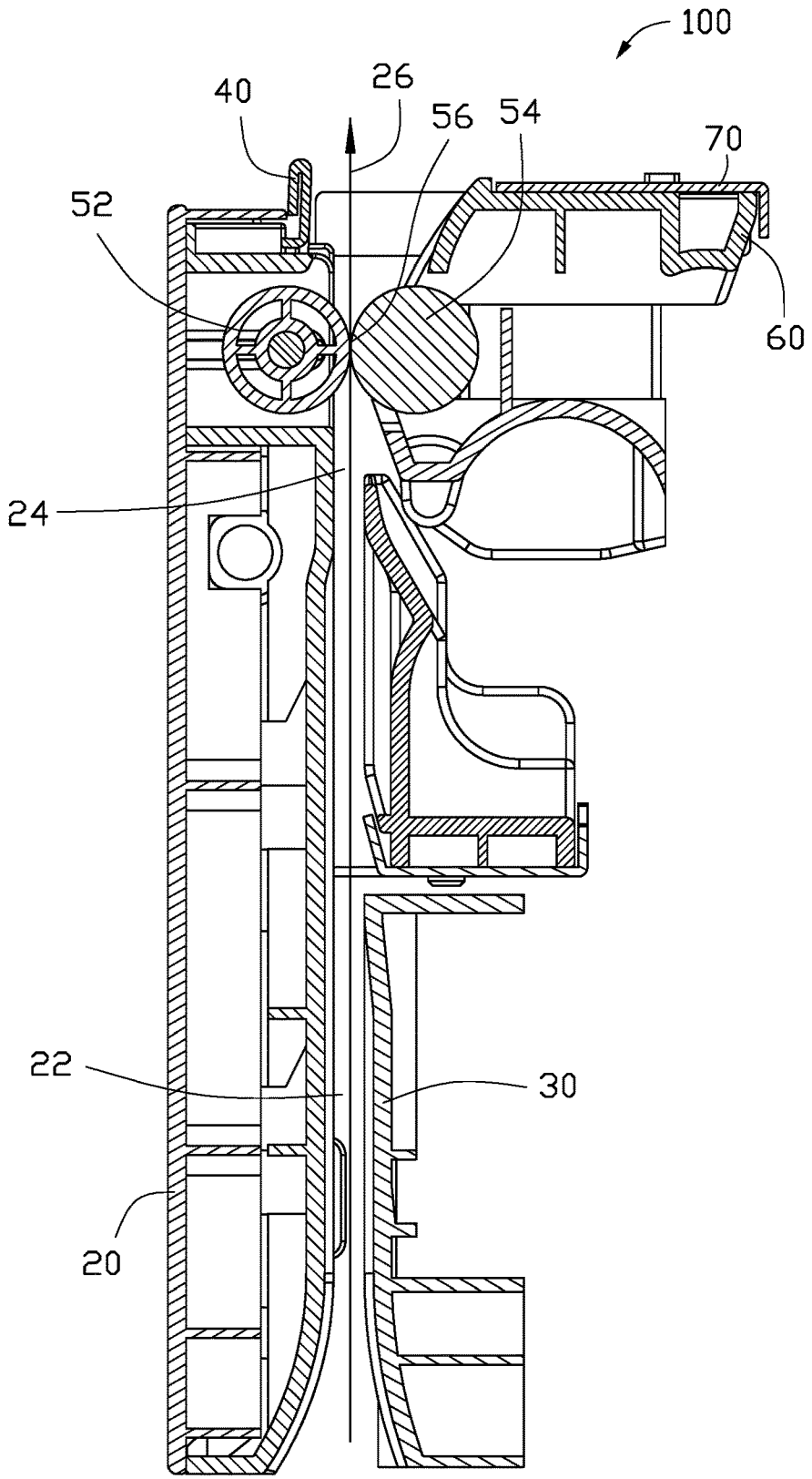
FIG. 3 is a cross-section view of the paper transporting structure along line in FIG. 1.
Figure 4:
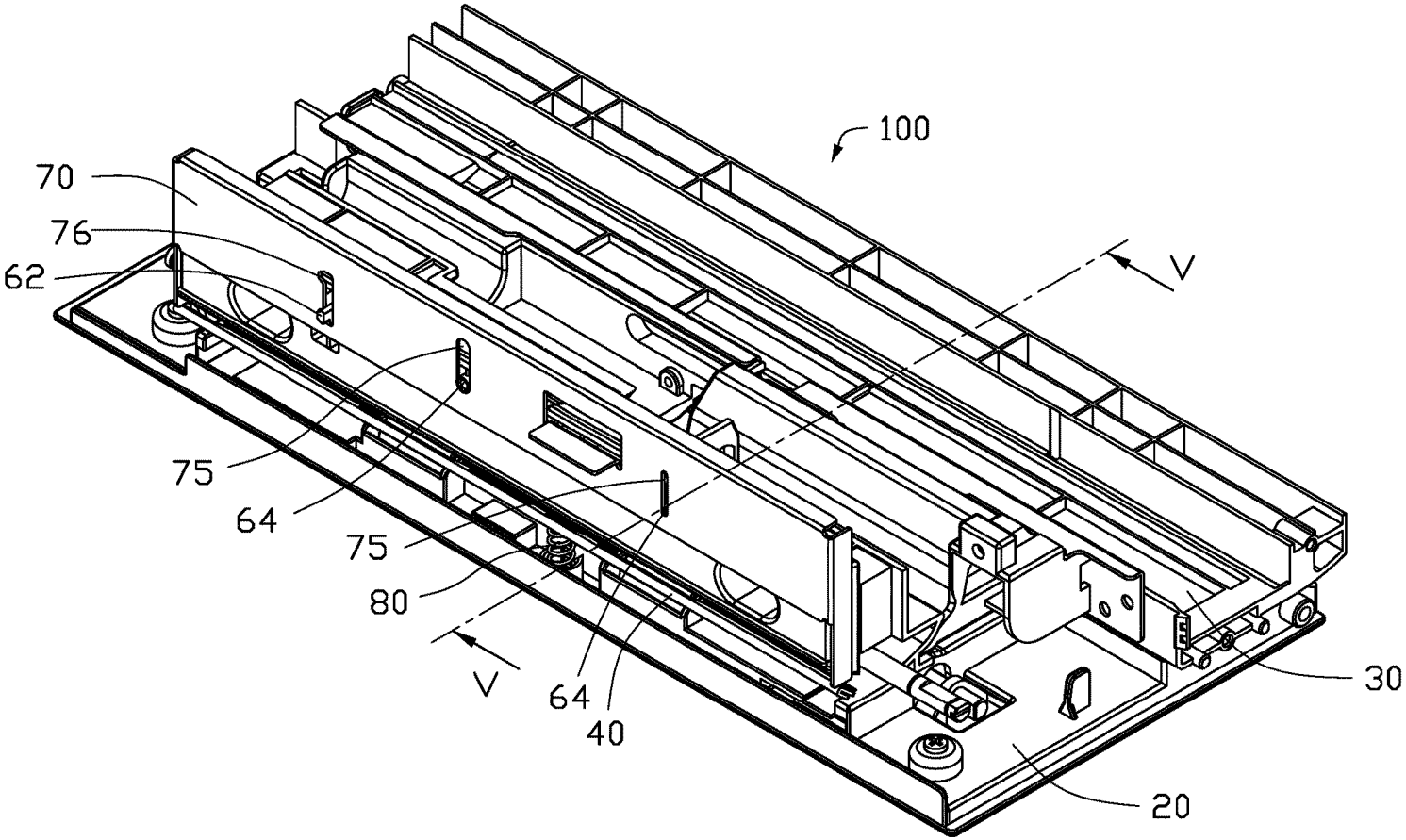
FIG. 4 is similar to FIG. 1, but the rotating arm is positioned at a second paper transporting angle.
Figure 5:
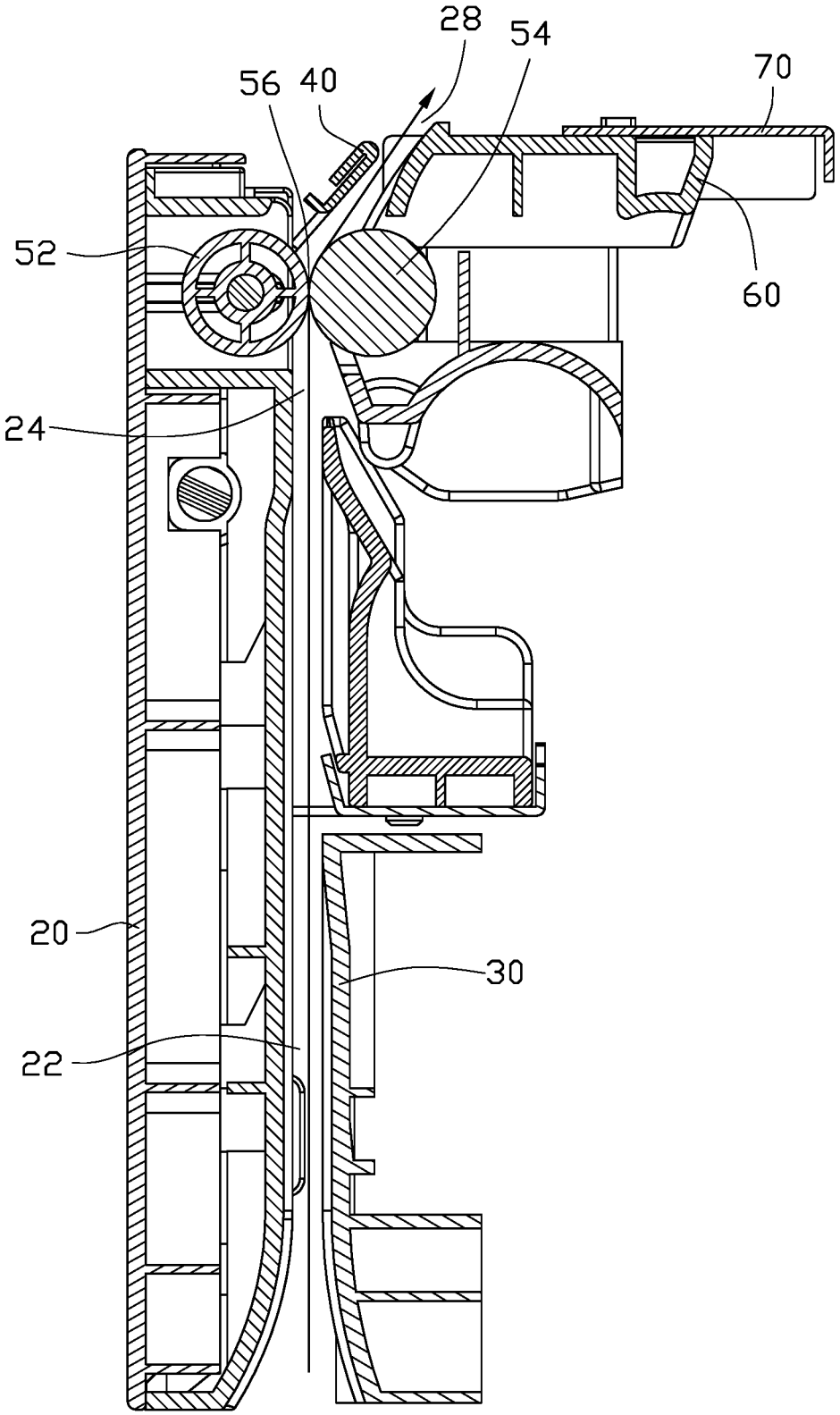
FIG. 5 is a cross-section view of the paper transporting structure along V-V line in FIG. 4.

FIG. 1 to FIG. 5 illustrate a paper transporting structure 100 including a paper transporting gate 20, a paper guide 30, a rotating arm 40, a paper transferring assembly 50, a fixing holder 60, a sliding piece 70, and an elastic member 80. The paper guide 30 is fixed above the paper transporting gate 20. The paper transporting gate is part of a pivotable door attached to the rest of the printer (not shown) A paper transport channel 22 is defined between the paper transporting gate 20 and the paper guide 30. The rotating arm 40 is rotatably attached to the paper transporting gate 20 and positioned at an outlet 24 of the paper transport channel 22. The fixing holder 60 is attached to the paper guide 30 and positioned at the outlet 24. The sliding piece 70 is slidably attached to the fixing holder 60. The elastic member 80 is attached to the paper transporting gate 20 and abuts the rotating arm 40.

When an external force is exerted on the sliding piece 70 to drive the sliding piece 70 to slide to a first position of the fixing holder 60, the sliding piece 70 is fixed at the first position and abuts the rotating arm 40 to hold the rotating arm 40 positioned at a first paper transporting angle 26. The paper transferring assembly 50 transfers a paper in the paper transport channel 22 to the rotating arm 40 and drives the paper to leave the rotating arm 40 in the first paper transporting angle 26. When an external force is exerted on the sliding piece 70 to drive the sliding piece 70 to slide to a second position of the fixing holder 60, the elastic member 80 rebounds and drives the rotating arm 40 to rotate to a second paper transporting angle 28. The paper transferring assembly 50 transfers a paper in the paper transport channel 22 to the rotating arm 40 and drives the paper to leave the rotating arm 40 in the second paper transporting angle 28.

The paper transferring assembly 50 includes at least one drive wheel 52 and at least one driven wheel 54. A motor for driving driven wheel 54 is not shown. The drive wheel 52 is attached to the paper transporting gate 20 and is adjacent to the rotating arm 40. The driven wheel 54 is opposite to the drive wheel 52. A paper transferring gap 56 is defined between the driven wheel 54 and the drive wheel 52. The paper transferring assembly 50 transfers the paper to the paper transferring gap 56 and the paper passes through the paper transferring gap 56 to be transferred to the rotating arm 40. In the exemplary embodiment, the paper transferring assembly 50 includes two drive wheels 52 and two driven wheels 54.

The fixing holder 60 includes an elastic protruding hook 62 opposite to the sliding piece 70. The sliding piece 70 defines a sliding groove 72. The sliding groove 72 includes a sliding area 74, a first locking groove 76, and a second locking groove 78. The sliding area 74 is positioned between the first locking groove 76 and the second locking groove 78. In the embodiment, the first locking groove 76 and the second locking groove 78 are positioned at two ends of the sliding area 74. When the sliding piece 70 slides to lock the elastic protruding hook 62 in the first locking groove 76, the sliding piece 70 abuts the rotating arm 40 to hold the rotating arm 40 positioned at the first paper transporting angle 26. When the elastic protruding hook 62 slides along the sliding area 74 to be locked in the second locking groove 78, the elastic member 80 rebounds and drives the rotating arm 40 to rotate to the second paper transporting angle 28.

The fixing holder 60 further includes at least one guiding portion 64 opposite to the sliding piece 70. The sliding piece 70 further defines at least one guiding groove 75. The guiding portion 64 is slidably received in the guiding groove 75 to guide the sliding piece to slide. In the embodiment, the fixing holder 60 includes two guiding portions 64. The sliding piece 70 defines two guiding grooves 75.

The paper transporting gate 20 defines a cylindrical receiving hole 21. The elastic member 80 is received in the receiving hole 21 and abuts the rotating arm 40. The elastic member 80 can be a spiral spring. The paper transporting gate 20 further defines two opposite accommodating holes 23. Two rotating portions 42 protrude from each of the two ends of the rotating arm 40. The two rotating portions 42 are rotatably received in the two accommodating holes 23. An axis of the receiving hole 21 is perpendicular to an axis of the accommodating hole 23.

The exemplary embodiments shown and described above are only examples. Even though numerous descriptions and advantages of the present technology have been set forth in the foregoing description, together with details of the structure and function of the present disclosure, the disclosure is illustrative only, and changes may be made in the details, including in matters of shape, size, and arrangement of the parts within the principles of the present disclosure, up to and including the full extent established by the broad general meaning of the terms used in the claims.

What is claimed is:

1. A paper transporting structure comprising:

a paper transporting gate;

a paper guide, a paper transport channel defined between the paper transporting gate and the paper guide;

a rotating arm rotatably attached to the paper transporting gate and positioned at an outlet of the paper transport channel;

a paper transferring assembly for transferring a paper in the paper transport channel to the rotating arm;

a fixing holder attached to the paper guide and positioned at the outlet;

a sliding piece slidably attached to the fixing holder; and an elastic member attached to the paper transporting gate and abutting the rotating arm;

wherein when the sliding piece slides to a first position of the fixing holder, the sliding piece is fixed at the first position and abuts the rotating arm to hold the rotating arm positioned at a first paper transporting angle, when the sliding piece slides to a second position of the fixing holder, the elastic member rebounds and drives the rotating arm to rotate to a second paper transporting angle.

2. The paper transporting structure as claimed in claim 1, wherein paper transferring assembly comprises at least one drive wheel and at least one driven wheel, the drive wheel is attached to the paper transporting gate and is adjacent to the rotating arm, the driven wheel is opposite to the drive wheel, a paper transferring gap is defined between the driven wheel and the drive wheel, the paper transferring assembly transfers the paper to the paper transferring gap and the paper passes through the paper transferring gap to be transferred to the rotating arm.

3. The paper transporting structure as claimed in claim 2, wherein the paper transferring assembly comprises two drive wheels and two driven wheels.

4. The paper transporting structure as claimed in claim 1, wherein the fixing holder comprises an elastic protruding hook opposite to the sliding piece, the sliding piece defines a sliding groove, the sliding groove comprises a sliding area, a first locking groove and a second locking groove, the sliding area is positioned between the first locking groove and the second locking groove, when the sliding piece slides to lock the elastic protruding hook in the first locking groove, the sliding piece abuts the rotating arm to hold the rotating arm positioned at the first paper transporting angle, when the elastic protruding hook slides along the sliding area to be locked in the second locking groove, the elastic member rebounds and drives the rotating arm to rotate to the second paper transporting angle.

5. The paper transporting structure as claimed in claim 4, wherein the first locking groove and the second locking groove are positioned at opposite ends of the sliding area.

6. The paper transporting structure as claimed in claim 4, wherein the fixing holder further comprises at least one guiding portion opposite to the sliding piece, the sliding piece further defines at least one guiding groove, the guiding portion is slidably received in the guiding groove.

7. The paper transporting structure as claimed in claim 6, wherein the fixing holder comprises two guiding portions, the sliding piece defines two guiding grooves.

8. The paper transporting structure as claimed in claim 1, wherein the paper transporting gate defines a receiving hole, the elastic member is received in the receiving hole and abuts the rotating arm.

9. The paper transporting structure as claimed in claim 8, wherein the paper transporting gate further defines two opposite accommodating holes, two rotating portions, each rotating portion protruding from an end of the rotating arm, the two rotating portions are rotatably received in the two accommodating holes.

10. The paper transporting structure as claimed in claim 9, an axis of the receiving hole is perpendicular to an axis of the accommodating hole.

11. A paper transporting structure comprising:

a paper transporting gate;

a paper guide, a paper transport channel defined between the paper transporting gate and the paper guide;

a rotating arm rotatably attached to the paper transporting gate;

a paper transferring assembly driving a paper to pass though the paper transport channel to the rotating arm;

a fixing holder attached to the paper guide;

a sliding piece slidably attached to the fixing holder; and an elastic member attached to the paper transporting gate and abutting the rotating arm;

wherein when the sliding piece slides to a first position of the fixing holder, the sliding piece is fixed at the first position and abuts the rotating arm to hold the rotating arm positioned at a first paper transporting angle, when the sliding piece slides to a second position of the fixing holder, the elastic member rebounds and drives the rotating arm to rotate to a second paper transporting angle.

12. The paper transporting structure as claimed in claim 11, wherein paper transferring assembly comprises at least one drive wheel and at least one driven wheel, the drive wheel is attached to the paper transporting gate and is adjacent to the rotating arm, the driven wheel is opposite to the drive wheel, a paper transferring gap is defined between the driven wheel and the drive wheel, the paper transferring assembly transfers the paper to the paper transferring gap and the paper passes through the paper transferring gap to be transferred to the rotating arm.

13. The paper transporting structure as claimed in claim 12, wherein the paper transferring assembly comprises two drive wheels and two driven wheels.

14. The paper transporting structure as claimed in claim 11, wherein the fixing holder comprises an elastic protruding hook opposite to the sliding piece, the sliding piece defines a sliding groove, the sliding groove comprises a sliding area, a first locking groove and a second locking groove, the sliding area is positioned between the first locking groove and the second locking groove, when the sliding piece slides to lock the elastic protruding hook in the first locking groove, the sliding piece abuts the rotating arm to hold the rotating arm positioned at the first paper transporting angle, when the elastic protruding hook slides along the sliding area to be locked in the second locking groove, the elastic member rebounds and drives the rotating arm to rotate to the second paper transporting angle.

15. The paper transporting structure as claimed in claim 14, wherein the first locking groove and the second locking groove are positioned two ends of the sliding area.

16. The paper transporting structure as claimed in claim 14, wherein the fixing holder further comprises at least one guiding portion opposite to the sliding piece, the sliding piece further defines at least one guiding groove, the guiding portion is slidably received in the guiding groove.

17. The paper transporting structure as claimed in claim 16, wherein the fixing holder comprises two guiding portions, the sliding piece defines two guiding grooves.

18. The paper transporting structure as claimed in claim 11, wherein the paper transporting gate defines a receiving hole, the elastic member is received in the receiving hole and abuts the rotating arm.

19. The paper transporting structure as claimed in claim 18, wherein the paper transporting gate further defines two opposite accommodating holes, two rotating portions, each rotating portion protruding form an end of the rotating arm, the two rotating portions are rotatably received in the two accommodating holes.

20. The paper transporting structure as claimed in claim 19, an axis of the receiving hole is perpendicular to an axis of the accommodating hole.

* * * * *